United States Patent [19]

Lorenz et al.

[11] Patent Number: 4,559,107

[45] Date of Patent: Dec. 17, 1985

[54] METHOD FOR DRY COOLING COKE

[75] Inventors: Kurt Lorenz, Hattingen; Engelbert Bruns, Recklinghausen; Gerd Osterholt, Dorsten, all of Fed. Rep. of Germany

[73] Assignee: Firma Carl Still GmbH & Co. KG., Recklinghausen, Fed. Rep. of Germany

[21] Appl. No.: 601,445

[22] Filed: Apr. 18, 1984

Related U.S. Application Data

[62] Division of Ser. No. 465,254, Feb. 9, 1983.

[30] Foreign Application Priority Data

Feb. 26, 1982 [DE] Fed. Rep. of Germany ..... 3206938

[51] Int. Cl.[4] ..... C10B 39/02

[52] U.S. Cl. ..... 201/39

[58] Field of Search ..... 202/227, 228, 239, 262, 202/263, 266, 269, 270; 201/39–41; 414/287, 288, 291, 292, 301–303

[56] References Cited

U.S. PATENT DOCUMENTS

| | | | |
|---|---|---|---|
| 4,009,081 | 2/1977 | Ueda et al. | 202/227 |
| 4,028,192 | 6/1977 | Bender et al. | 202/263 |
| 4,092,222 | 5/1978 | Kataoka et al. | 202/228 |
| 4,286,912 | 9/1981 | Galow et al. | 414/287 |

FOREIGN PATENT DOCUMENTS

| | | | |
|---|---|---|---|
| 3011575 | 10/1981 | Fed. Rep. of Germany | 202/227 |
| 0518961 | 7/1978 | U.S.S.R. | 202/228 |

*Primary Examiner*—Peter Kratz

*Attorney, Agent, or Firm*—McGlew & Tuttle

[57] ABSTRACT

A method of dry cooling coke using a coke transporting bucket which has a removable cover with an exhaust pipe extending from the interior of the bucket to an exterior exhaust connection and a cooling shaft for the coke comprises directing red hot coke into the bucket, covering the bucket with the cover and transporting the coke to the cooling shaft and connecting the exhaust pipe to the exhaust system while the bucket is in the shaft and emptying the bucket into the cooling shaft. The coke transporting bucket comprises a container having a bottom discharge which is closable by a flap and a removable cover which seats around the rim of the container to seal it. An exhaust pipe is carried by the cover and it extends into the interior thereof for removing gases from within the bucket and delivering them to an exterior connection which is connectable to an exhaust line. One or two exhaust pipes may be provided on the cover and each includes cover flaps which are biased into a closed position but which open to connect to the exhaust system when the cover is positioned to engage the exhaust line. The cover advantageously includes longitudinal girders which extend outwardly from each side or end of the cover and provide a means, for supporting the cover when the bucket is lowered beneath a support structure to free the cover from the bucket.

5 Claims, 4 Drawing Figures

METHOD FOR DRY COOLING COKE

This is a division of application Ser. No. 465,254 filed Feb. 9, 1983.

FIELD AND BACKGROUND OF THE INVENTION

This invention relates in general to coking and in particular to a new and useful method and apparatus for dry cooling hot coke.

The invention concerns a method for the dry cooling of coke, where the red hot coke is forced into a bucket, fed in the bucket to the cooling shaft, and then emptied into the cooling shaft. The coke bucket is transported covered and connected to an exhaust system, while the coke is emptied into the cooling shaft. The invention also concerns a coke bucket with a cover which covers the receiving space for the coke bucket with a cover which covers the receiving space for the coke and which has a pipe connection that can be coupled to the exhaust line.

Dry cooling of coke means the continuous cooling of the red hot coke in a cooling shaft, where the red hot coke is cooled by the inert gases and by the cooled walls of the cooling shaft, if necessary, without emissions. The red hot coke is then fed by means of a coke bucket from the coke oven to the cooling device, lifted, and then attached on the cooling shaft and emptied by operating bottom flap of the bucket. In order to prevent gas and dust from escaping to the outside during the filling operation, the transition range between the coke bucket and the cooling shaft is encapsulated, and this area is connected to an exhaust line.

It is known (German Pat. No. 27 01 005.5) to cover the coke bucket with respect to the atmosphere during its transportation by means of a cover called a hood in order to avoid the liberated gases and dust, if any, into the atmosphere, which would lead to pollution of the environment. Connected to this cover is a pipe line which is connected to a pipe socket of an exhaust line when the coke bucket is deposited on the cooling shaft or a transfer hopper, so that the gases contained in the bucket can be exhausted. A disadvantage is that the cover must be moved during the entire transportation operation, which can lead among other things to damage and impairment of the operation, because of the projecting pipe socket. Beyond that, the cover must be lifted before the coke is forced-in and must be attached again after the bucket is filled. This requires special cover elevating systems, because the cover must be moved together with the lead car for the coking mass and/or the coke bucket. A disadvantage is also the design of the cover, because the pipe connection projects like a gallow, and the cover can therefore easily be moved and be damaged by contact.

SUMMARY OF THE INVENTION

The invention is based on the problem of simplifying the transportation of the red hot coke without polluting the environment, and to provide a suitable coke bucket with cover.

According to the invention the coke bucket is closed from the top when it is lifted from the quenching track and then moved in the shaft scaffold with the cover attached.

In the method of the invention, the cover thus remains in the shaft scaffold when the empty coke bucket is moved over the quenching track to another coke oven. When the coke bucket which is now filled with red hot coke returns, enters the shaft scaffold and is lifted from the quenching track, it takes along the cover and is now shielded from the atmosphere until it is emptied and deposited on the quenching track. No special operation and no special device is thus required for lifting and depositing the cover, which leads to a simplification of the method without substantially polluting the environment. At the same time the transportation of the coke bucket is also simplified, because the bulky cover remains inside the shaft scaffold, to be attached again when a new filled bucket approaches.

During the movement of the coke bucket in the shaft scaffold and the placement of the bucket on the cooling shaft, the liberated gases can be prevented, in an advantageous manner, from issuing into the atmosphere. This is done by first collecting the gases during the movement of the coke bucket and then exhausting the gases after the placement of the bucket on the cooling shaft. By a suitable design of the coke bucket or its cover, a cavity is provided which suffices to receive the gases liberated during the movement of the coke bucket in the shaft scaffold without the risk that these gases will escape into the atmosphere through some leaks, due to the internal pressure. Immediately after the coke bucket is deposited, the existing cavity and the entire interior of the coke bucket are connected to the exhaust line, and the gas is continuously exhausted. This ensures effective environment protection, without having to provide special holders or loading weights for the cover.

The method is carried out by means of a coke bucket with a cover which covers the receiving space or interior of the coke bucket and which has a pipe connection that can be coupled with the exhaust line. Such a cover is mounted detachably on the rim of the coke bucket according to the invention. It is designed to seal the interior from the atmosphere and has longitudinal girders protruding on two sides over the rim. Such a cover has a relatively low weight, is thus readily deposited on the upper rim of the coke bucket when the latter is lifted, and is deposited at a suitable point over the laterally projecting longitudinal girders in the shaft scaffold in such a way that the next filled coke bucket which automatically moves under it, is lifted, and takes along the cover. In order to make the preferably enlarged receiving space for the gas available during the movement in the shaft scaffold, the cover is convex according to another feature of the invention and the exhaust pipes equipped with the pipe connections are attached at the lowest highest point of the arc. With such a design there is a large collecting space available, and the gases can be exhausted at the same time over the exhaust pipe at a preferably lower exhaust velocity, which leads to a great reduction in the amount of dust discharged.

A tight seal of the exhaust line, which is under a vacuum, and of the pipe connection, is achieved according to the invention in that the exhaust line has a water seal corresponding with the pipe connection. In order to exhaust the gases as fast as possible it is advisable to provide two pipe connections and exhaust pipes, which are attached at the lowest point of the arc. These exhaust pipes with their connections are attached automatically on the exhaust line when the coke bucket is lowered into the rim of the cooling shaft so that this connection is absolutely tight and ensures an effective exhaust.

A very effective and still inexpensive dust removal from the gases carried along in the coke bucket is achieved according to the invention by forming the exhaust line so that it is forked at the end for the connection of the two exhaust pipes and has in this range a pipe socket which can be closed over a flap coupled with the cover flaps. Cool, fresh air is sucked in over this pipe socket with flap, so that the waste gases have such a low temperature in the exhaust line proper that the dust can be subsequently effectively removed in a cloth filter.

An altogether favorable space requirement, a favorable seal by the water seals, and a large exhaust cross-section are ensured by designing the exhaust pipes as rectangular pipes. Beyond that, such pipes are simple to produce at moderate cost.

The available large collecting space has an inhibiting effect on the issuance of gas from the closed coke bucket. But it is of advantage if the exhaust pipes have automatically opening flaps when the coke bucket is deposited. These flaps prevent additionally the issuance of gases during the movement of the coke bucket, while the flaps open automatically over a corresponding lever system and discharge weight during the establishment of the connection with the exhaust line. This prevents the gases effectively from issuing from the exhaust pipes and carrying along dust particles.

An advantageous stable and at the same time light weight design of the cover according to the invention is obtained if the cover is formed of the outer longitudinal girders and of crossbeams on which are arranged the insulating materials carried by a cover plate over tie rods. Such a cover can be very light, due to the above-described design, which is of great advantage in view of the otherwise very large coke bucket parts to be lifted and transported.

A simple possibility of depositing the cover in the bottom region of the shaft scaffold during the lowering of the coke bucket comprises according to the invention a construction in which the longitudinal girders are designed as double-t-girders, project over the cover, and are connected to crossbeams. In this way a sort of supporting construction is formed on which are then arranged in an advantageous manner the insulating materials with the cover plate. The projecting longitudinal girders form a stable cover deposit, and it is of advantage to make the cover flat in the rim area parallel to the longitudinal girders, and convex only in the middle. The longitudinal girders, which carry the closure or cover, are connected with the crossbeams and the cover plate.

The invention is particularly characterized in that a method is provided which permits an effective seal of the coke bucket in the most important phases without rendering the transportation more difficult. Besides, if the method according to the invention is used, it is not necessary to provide additional elevating and moving systems for the cover in the range of the coke ovens. Of advantage is also the lightweight design of the cover, and thus the easy handling and good seal from the coke bucket itself and from the exhaust line.

Accordingly it is an object of the invention to provide a method of dry cooling coke using a coke transporting bucket which has a removable cover with an exhaust pipe extending from the interior of the bucket to an exterior exhaust connection and a cooling shaft in which the coke is delivered, comprising directing the red hot coke into the bucket, covering the bucket with the cover and transporting the coke to the cooling shaft and connecting the exhaust pipe to the exahaust system while the bucket is in the shaft and emptying the bucket into the cooling shaft.

A further object of the invention is to provide a bucket for handling hot coke which is connectable to an exhaust system which comprises a container having a bottom with a discharge opening, a bottom flap closing the discharge opening which is openable to release the coke from the container through the discharge and wherein the container has an open top with a container rim surrounding the opening on which is seated a rim of a detachable cover which closes the top and has a rim which is sealed on the container rim, and including an exhaust pipe carried by the cover having an interior end opening in the interior of the cover to the container and an opposite exterior end terminating outside the cover in an exhaust connection for connecting the container to an exhaust system and further including at least one longitudinally extending girder secured to the exterior of the cover and having cover support portions extending beyond each side edge of the cover.

A further object of the invention is to provide a bucket for handling hot coke which is simple in design, rugged in construction and economical to manufacture.

The various features of novelty which characterize the invention are pointed out with particularity in the claims affixed to and forming a part of this disclosure. For a better understanding of the invention, its operating advantages and specific objects attained by its uses, reference is made to the accompanying drawings and descriptive matter in which preferred embodiments of the invention are illustrated.

GENERAL DESCRIPTION OF THE PREFERRED EMBODIMENTS

Figure 1:
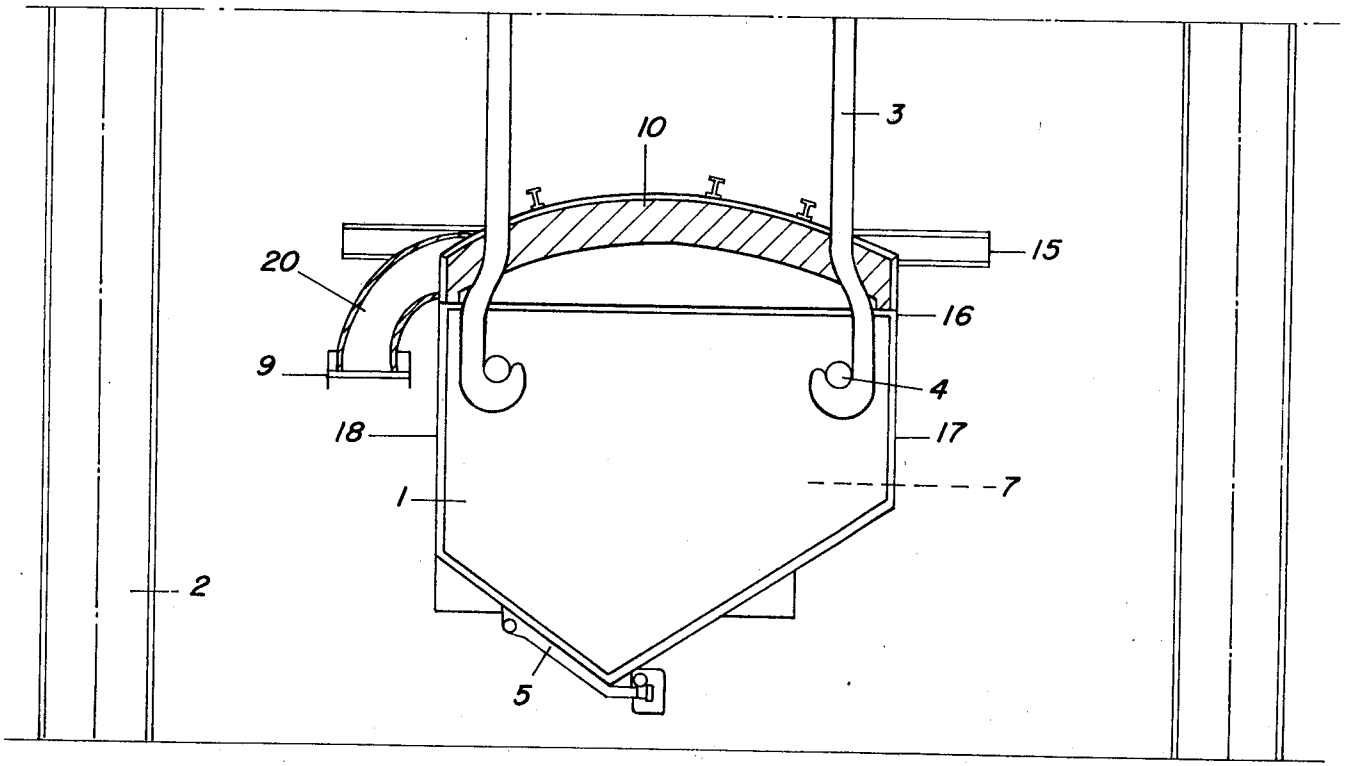
FIG. 1 is a side elevational view partly in section of a coke bucket arranged in a cooling shaft constructed in accordance with the invention.

Referring to the drawings in particular the invention embodied therein comprises a bucket 1 for handling hot coke. The bucket 1 is connectable to an exhaust system 6 (FIGS. 2 and 4) which for example is located in the interior of a cooling shaft scaffold 2 as shown in FIG. 1. The bucket 1 comprises a container which has a bottom with a discharge opening which is closed by a bottom flap 5 which is openable to release the coke from the bucket through the discharge so that the coke may fall downwardly in the shaft of scaffold 2 and be cooled. Container 1 has an open top with a container rim surrounding the opening. A detachable cover 10 closes the top and has a cover rim resting on the container rim and it seals the interior of the container. An exhaust pipe 20 is carried by the cover and it has one interior end opening into the interior of the cover and an opposite exterior end terminating outside the cover in an exhaust connection 9 for connecting the container to an exhaust system 6. In addition, the cover 10 in accordance with the invention includes at least one longitudinally extending girder which in the embodiment shown includes two girders 15 and 14 which are secured to the cover and include cover support portions which extend beyond each side edge of the cover.

The inventive method of dry cooling coke using a coke transporting bucket which has a removable cover with an exhaust pipe extending from the interior of the bucket to an exterior exhaust connection and also using a cooling shaft, comprises directing red hot coke into the bucket, covering the bucket with the cover 10 and transporting the coke to the cooling shaft scaffold 2. Thereafter, the bucket exhaust pipe 20 is connected to the exhaust system or pipe 6 while the bucket is in the shaft. The bucket is thereafter emptied into the cooling shaft of scaffold 2.

FIG. 1 shows the coke bucket 1 as it moves inside shaft scaffold 2 after it has been lifted from a transfer car (not shown).

Coke bucket 1 is suspended on a gripping gear or hoist 3 whose hooks are turned behind gripping cams 4 so that the bucket assumes a sufficiently stable position when moved inside the shaft scaffold.

Coke bucket 1, which can hold up to 40 t of red hot coke and more, has at its lower end the bottom flap 5, which is opened after coke bucket 1 has been deposited on the cooling shaft (not shown here), so that the coke can flow at a predetermined rate from coke bucket 1 into the cooling shaft.

Figure 2:
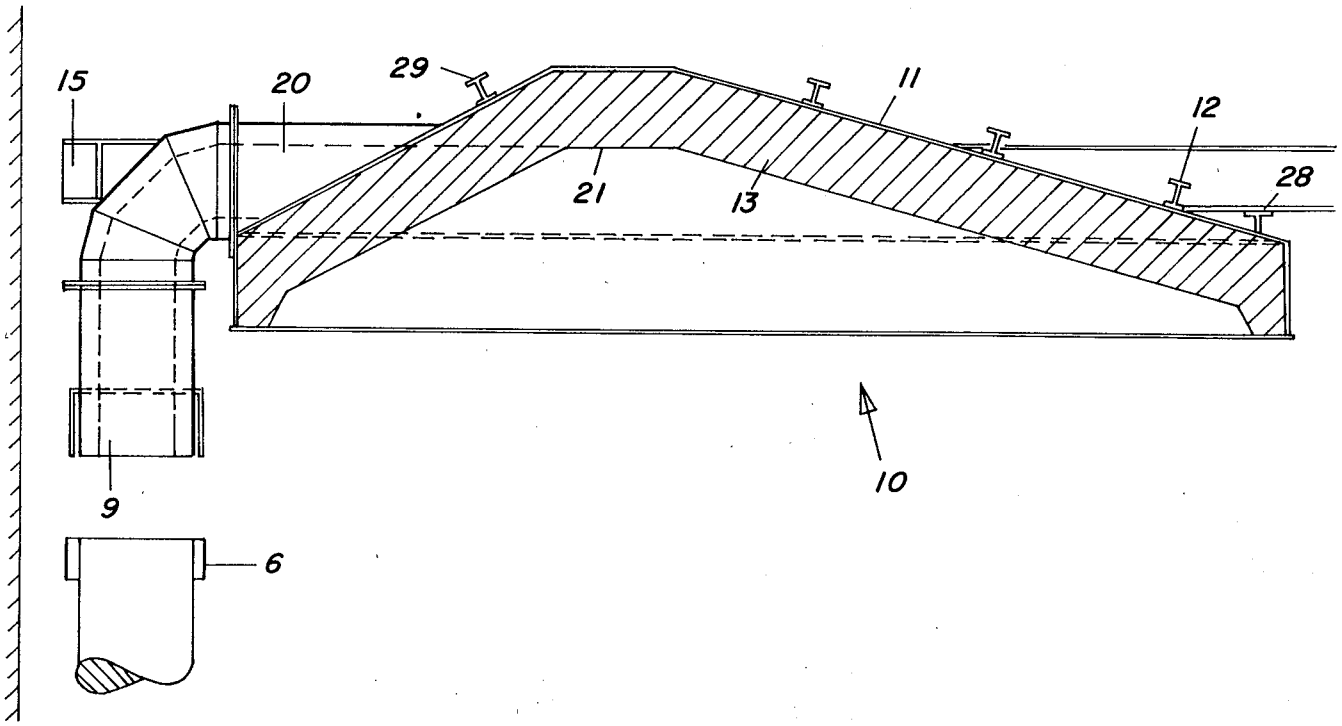
FIG. 2 is an enlarged longitudinal sectional view of the cover shown in FIG. 1.

The interior 7 of coke bucket 1 is so designed, as mentioned above, that it can receive up to 40 t of red hot coke and more. The gases formed are substantially collected during the movement inside shaft scaffold 2 and are then continuously exhausted and conducted into exhaust line 6, which is indicated in FIG. 2. For connection to this exhause line 6, cover 10 covering coke bucket 1 has laterally projecting pipe connection 9. When coke bucket 1 is lowered onto the cooling shaft, pipe connection 9 approaches exhaust line 6 so far that water seal assigned to exhaust line 6 becomes effective.

Figure 3:
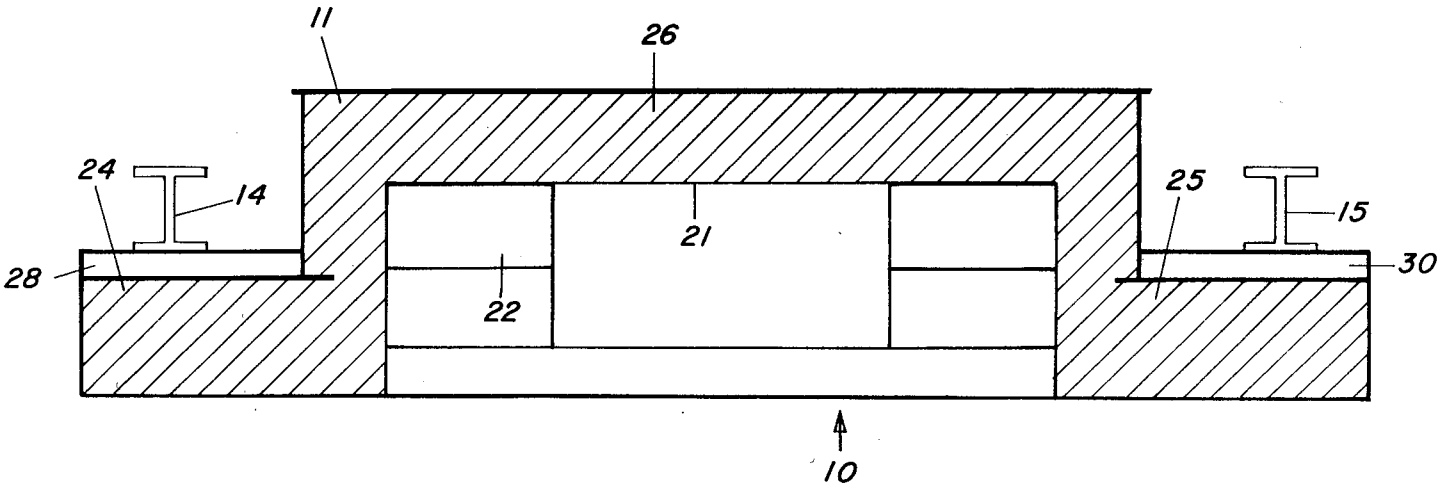
FIG. 3 is a sectional view transverse to the sectional view shown in FIG. 2.

Cover 10 comprises, as can be seen from FIGS. 1 to 3, cover plate 11 arranged underneath crossbeams 12, with insulating material 13 and longitudinal girders 14, 15. The rim area of the cover is so designed that it ensures an adequate support on rim 16 of the coke bucket 1.

Longitudinal girders 14 and 15 project over sides 17 and 18 of the coke bucket 1 and serve thus as a deposit for the cover or closure. As can be seen particularly from FIG. 3, girders 14 and 15 are connected with short crossbeams 28, 30 while crossbeams 12, 29 arranged in the convex part of cover 10 and shown in FIG. 2, are connected with longitudinal girders 14, 15 over posts 31 (not shown).

Exhaust pipe 20 or exhaust pipes 20 are connected at the highest point 21 of the arc, so that a uniform and reliable exhaust with a low exhaust rate is ensured as soon as the connection between exhaust line 6 and exhaust pipe 20 or pipe connection 9 has been established. Exhaust pipes 20 have a rectangular cross section and can be closed by cover flaps 22, so that the issuance of gas during the movement of coke bucket 1 inside shaft scaffold 2 into the atmosphere is very difficult. Pipes 20 also extend horizontally where they connect with cover 10 and before the top of the coker.

FIG. 3 shows that the convex form of cover 10 is confined to the central area 26, while the rim area 24, 25 is flat, so that the arrangement of the longitudinal girders 14 and 15 can be favorably effected. In the background are indicated the cover flaps 22 of exhaust pipes 20 respectively over which dustcontaining gas, collected in the cavity by the convex form of the cover, is exhausted.

Figure 4:
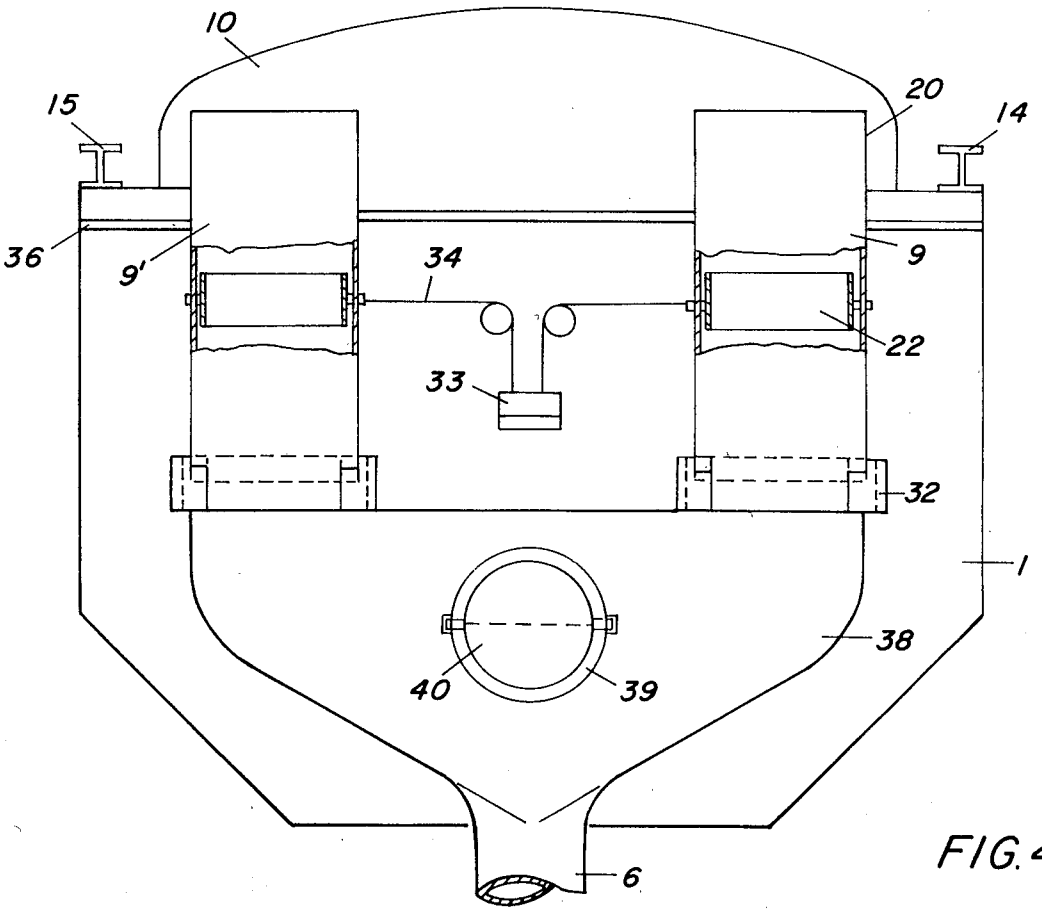
FIG. 4 is a partial end elevational view of the bucket shown in FIG. 1 indicating its connection to an exhaust line.

FIG. 4 shows the connection between exhaust line 6 and pipe connections 9, 9' and exhaust pipes 20. In pipe connections 9 are arranged the cover flaps 22, which open automatically over counterweight 33 and lever system 34 when coke bucket 1 is placed on the cooling shaft. After lifting coke bucket 1, cover flaps 22 are then so set that they render the issuance of gas from the interior of the coke bucket very difficult.

The connections between pipe connections 9, 9' and exhaust line 6 are sealed over water seals 32, while cover 10 itself bears on ring 36 of coke bucket 1.

For the connection of the two pipe connections 9, 9' to the exhaust line, the latter is forked at the end in the form of a U-piece 38. Both pipe connections 9, 9' are thus connected simultaneously with the exhaust and the dust removal system. In the center of U-piece 38 is provided a pipe socket 39, which can be closed by a flap 40. This flap is opened during the exhaust, so that cool and fresh air can enter, cooling the gases exhausted from coke bucket 1. It is thus possible to remove the dust from the exhausted gases at the end of exhaust line 6. Flap 40 is opened, more or less, depending on the collection and temperature of the gas.

While specific embodiments of the invention have been shown and described in detail to illustrate the application of the principles of the invention, it will be understood that the invention may be embodied otherwise without departing from such principles.

What is claimed is:

1. A method of dry cooling coke using a coke transporting bucket which comprises a container having a bottom with a discharge opening, a bottom flap for closing the discharge opening which is openable to release coke from the container and an open top with a container rim surrounding the open top, a cover having a cover rim engageable with the container rim for closing the container and sealing an interior of the container, the cover having an exhaust pipe terminating outside the cover in a downwardly extending exhaust connection, and an exhaust system with an upwardly open exhaust line in the cooling shaft, the method comprising:

transporting the bucket to a coke oven;

filling the bucket with red hot coke from the coke oven through the open top of the bucket;

transporting the bucket to the cooling shaft at a location under the cover;

lifting the bucket while it is filed with coke and positioned under the cover for bringing the cover rim into sealing engagement with the container rim;

moving the bucket to a position in the cooling shaft for discharging the coke therein and for engaging the downwardly extending exhaust connection of the cover with the upwardly open exhaust line of the exhaust system; and opening the bottom flap of the bucket for discharging coke through the discharge opening of the bucket.

2. A method according to claim 1, wherein the downwardly extending exhaust connection is closed during movement of the bucket with the cover thereon to the location in the cooling shaft for discharging the coke.

3. A method according to claim 2, including using a cover having a central convex portion forming an interior raised portion over the cover rim, the exhaust pipe having a horizontal portion extending from a highest part of the interior raised portion outwardly to the downwardly extending exhaust connection.

4. A method according to claim 3, including using a cover with a pair of flat rim areas on either side of the interior raised portion, each having a girder connected thereto for supporting the cover in the cooling shaft scaffold when the cover is not in a position covering the bucket.

5. A method according to claim 4, including using a water seal having a water-containing portion connected to the upwardly open exhaust line of the exhaust system and a water engaging portion connected to the downwardly extending exhaust connection of the cover exhaust pipe.

* * * * *